US005199505A

United States Patent [19]

Izumisawa

[11] Patent Number: 5,199,505

[45] Date of Patent: Apr. 6, 1993

[54] ROTARY IMPACT TOOL

[75] Inventor: Osamu Izumisawa, Tokyo, Japan

[73] Assignee: Shinano Pneumatic Industries, Inc., Kamiminochi, Japan

[21] Appl. No.: 690,624

[22] Filed: Apr. 24, 1991

[51] Int. Cl.[5] ..... B25B 21/02

[52] U.S. Cl. ..... 173/93.6

[58] Field of Search ..... 173/93.6, 93.5, 93

[56] References Cited

U.S. PATENT DOCUMENTS

| | | | |
|---|---|---|---|
| 2,339,531 | 1/1944 | Sittert et al. | 173/93.6 |
| 2,881,884 | 4/1959 | Amtsberg | 192/30.5 |
| 3,053,360 | 9/1962 | Madsen | 173/93.6 |
| 3,174,597 | 3/1965 | Schaedler et al. | 173/93.6 |
| 3,237,703 | 3/1966 | Ramstrom | 173/93.6 |
| 3,414,066 | 12/1968 | Wallace | 173/93.6 |
| 3,605,914 | 9/1971 | Kramer | 173/93 |
| 3,661,217 | 5/1972 | Maurer | 173/93.5 |
| 4,232,750 | 11/1980 | Antipov et al. | 173/93.6 |
| 4,313,505 | 2/1982 | Silvern | 173/93.5 |
| 4,821,611 | 4/1989 | Izumisawa | 173/93.6 |

*Primary Examiner*—Douglas D. Watts

*Assistant Examiner*—Scott A. Smith

*Attorney, Agent, or Firm*—Senniger, Powers, Leavitt & Roedel

[57] ABSTRACT

A rotary impact tool including a generally tubular cage rotated by a motor about a central longitudinal axis of the cage. The cage has an internal wall with axially extending guide channels formed in it for receiving hammer pins capable of moving axially in the guide channels. The hammer pins have a generally flat striking surface. An output shaft mounted generally coaxially with the cage for rotation relative to the cage has radially outwardly projecting anvils having generally flat impact surfaces. A clutch mechanism intermittently moves the hammer pins to an extended position in which the striking surfaces of the hammer pins are in registration with the impact surfaces of the anvils. The striking surfaces of the hammer pins strike the impact surfaces of the anvils upon further rotation of the cage for delivering an impact to the output shaft, and then withdrawn by the clutch mechanism to regain momentum.

14 Claims, 4 Drawing Sheets

ROTARY IMPACT TOOL

BACKGROUND OF THE INVENTION

This invention relates generally to power driven hand tools and more specifically to a rotary impact wrench having an intermittent drive clutch mechanism.

Rotary impact wrenches of the type to which the present invention is related have employed different mechanisms for applying an impact force to an output shaft for turning a fastener element, such as a nut. These impacts develop relatively instantaneously high torque in the output shaft for tightening (or loosening) the fastener elements. Most rotary impact mechanisms include an output shaft formed in part as an anvil periodically impacted by hammers. The hammers are typically mounted for motion with respect to the anvil and a clutch mechanism is provided to periodically move the hammers between a position in which the hammers will strike the anvil, and a position in which they are clear of the anvil. When clear of the anvil, the hammers gain speed, and hence momentum, for the next impact with the anvil.

There are presently several types of impact mechanisms. One type of rotary impact wrench, such as shown in U.S. Pat. No. 3,661,217, uses a "swinging weight" mechanism in which hammer dogs are mounted for pivoting about axes parallel to, but spaced from the central axis of the output shaft. A lobe on the output shaft forms the anvil to be struck by the hammer dogs. The hammer dogs, which also rotate around the output shaft, periodically strike the anvil to deliver an impact to the output shaft. In another type of impact mechanism, a spring biases each hammer toward a position in which the hammer is in engagement with the anvil. However, cam balls riding in raceways in a motor driven shaft periodically force the hammers out of engagement with the anvil.

A third type of rotary impact wrench, such as shown in U.S. Pat. No. 2,881,884 and to which the present invention is particularly related, employs a "ski-jump" mechanism in which the output shaft is mounted for free rotation about its longitudinal axis in a tubular cage rotated by a motor about its longitudinal axis. The output shaft has two anvils projecting radially outward in opposite directions. Hammers mounted for rotation with the cage are spring biased axially away from the anvils, but connected to a cam follower for axial motion. A cam ball rotating with the cage periodically engages the cam follower, throwing the hammers forward into registration with the anvils so that they strike the anvils to deliver an impact force for turning the output shaft with a relatively instantaneous high torque.

Some of the prior "ski-jump" clutch mechanisms have taken the form of generally cylindrical pins which ride in generally U-shaped grooves formed at radially opposing positions in the internal wall of the cage. The grooves extend longitudinally of the cage to allow axial movement of the hammers in the grooves. The pins have narrow portions adjacent one end forming a circumferential recess or neck for receiving a portion of a cam follower therein. This interconnection transmits the axial motion of the cam follower in response to engagement with the cam ball to the pins to throw them into registration with the anvils on the output shaft.

The hammer pins fit relatively loosely in the channels so that upon impact with the anvils, there is some risk that the hammer pins will move radially out of the channels as well as laterally in the channels. This movement causes high stress at the neck of the pins, which may result in breakage of the pins at this location. Moreover, the radial and lateral movement of the hammer pins in their respective channels reduces the amount of pin surface area coming into registration with the anvils so that the impact tends to chip the pins and inefficiently transfer momentum to the anvils. The same problem occurs when the wrench is operated at higher than rated air pressures, which causes the hammer pins to rotate so rapidly that a smaller than designed length of the pins come into registration with the anvils before the pins impact the anvils. Moreover, the cylindrical shape of the pins allows for only a narrow line of surface contact between each anvil and pin. This small area of contact results in less efficient transfer of momentum from the pins to the anvils during the impact.

SUMMARY OF THE INVENTION

Among the several objects and features of the present invention may be noted the provision of a power-driven rotary impact tool which efficiently transfers momentum from hammers to anvils; the provision of such a tool which will operate for long periods without failure; the provision of such a tool which prevents movement of the hammers out of proper alignment; the provision of such a tool constructed to reduce stress concentration in the hammers; and the provision of such a tool which is simple in design and inexpensive to manufacture.

Generally, a rotary impact tool constructed according to the principles of the present invention includes a housing, a motor mounted in the housing and a generally tubular cage connected to the motor for rotation of the cage about a central longitudinal axis of the cage. The cage has an internal wall with axially extending guide channel means formed therein. An output shaft mounted generally coaxially with the cage for rotation relative to the cage includes anvil means projecting radially outwardly from the output shaft and having a generally flat impact surface. Hammer means disposed in said guide channel means for movement with the cage has a generally flat striking surface. Clutch means intermittently moves said hammer means axially in said guide channel means between a retracted position in which the striking surface of said hammer means is clear of the impact surface of said anvil means for permitting rotation of the cage and said hammer means relative the output shaft, and an extended position in which the striking surface of said hammer means is in registration with the impact surface of said anvil means. In the extended position, the striking surface of said hammer means strikes the impact surface of said anvil means upon further rotation of the cage for delivering an impact to said anvil means.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
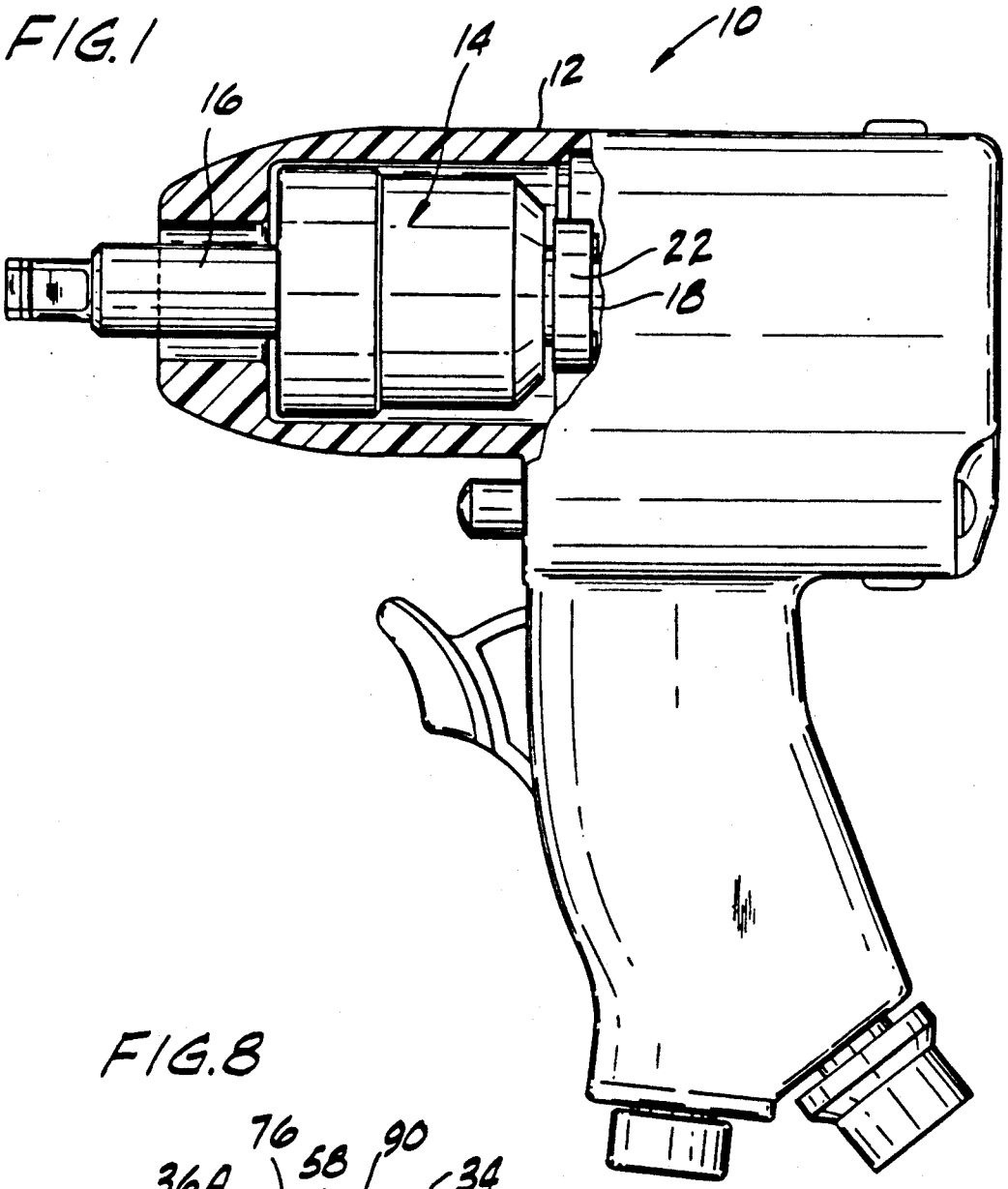
FIG. 1 is an elevation of a rotary impact tool of the present invention with parts broken away to show the cage and output shaft of the tool.

Referring now to the drawings, and in particular to FIG. 1, an air-driven rotary impact wrench, generally indicated at 10, constructed according to the principles of the present invention is shown to comprise a housing 12, a generally tubular cage 14 supported in the housing for rotation relative the housing, and an output shaft 16 which turns a fastener element (not shown), such as a nut or a bolt, for tightening or loosening the fastener element. A motor (not shown) in the housing 12 is a standard air driven motor of the type commonly used in pneumatic tools, which turns an input shaft 18 supported by shaft bearing 22. It is to be understood that other types of motors could be used and still fall within the scope of the present invention. The input shaft 18 is has splines (not shown) at its forward end for connection to corresponding splines 24 (FIG. 2) in an opening 26 in the rearward end of the cage 14 so that the motor rotates the cage about its central longitudinal axis.

Figure 4:
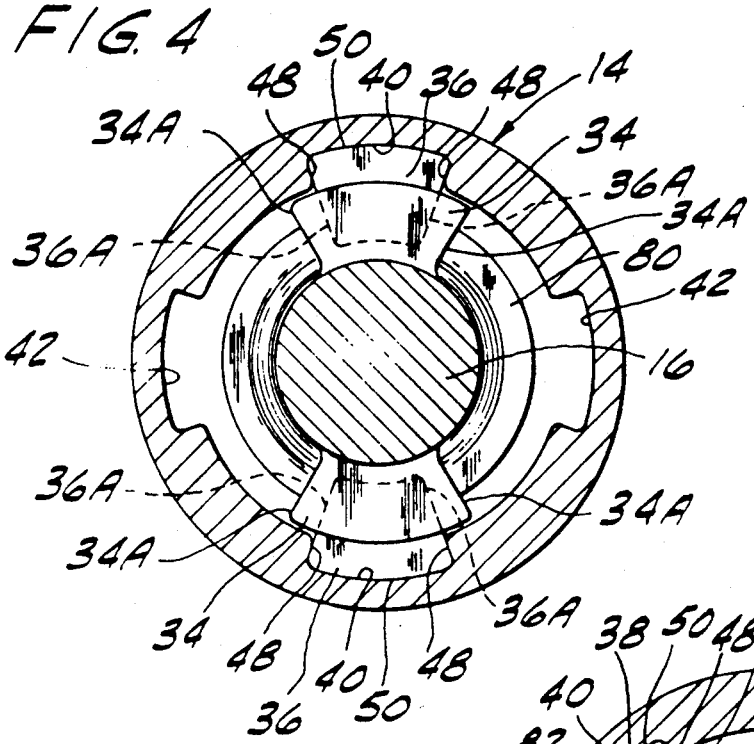
FIG. 4 is a section taken in the plane including line 4—4 of FIG. 2.
Figure 5:
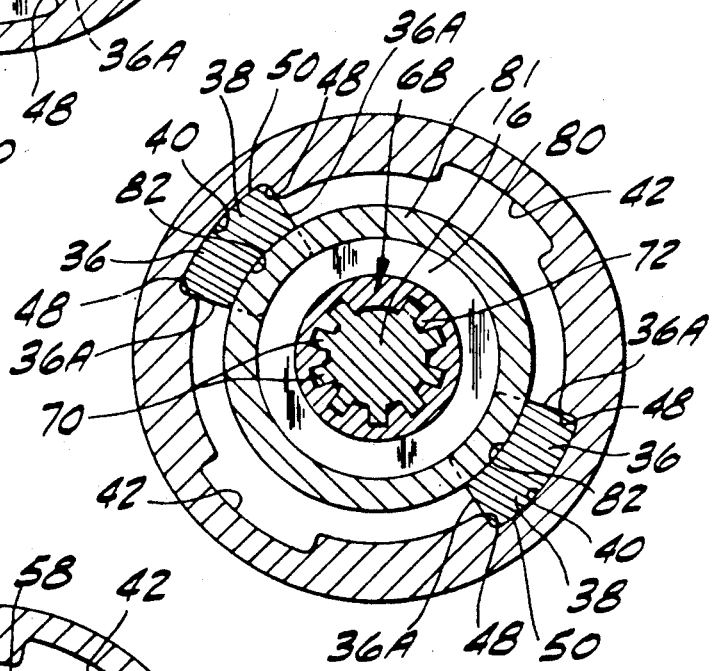
FIG. 5 is a section taken in the plane including line 5—5 of FIG. 3.
Figure 6:
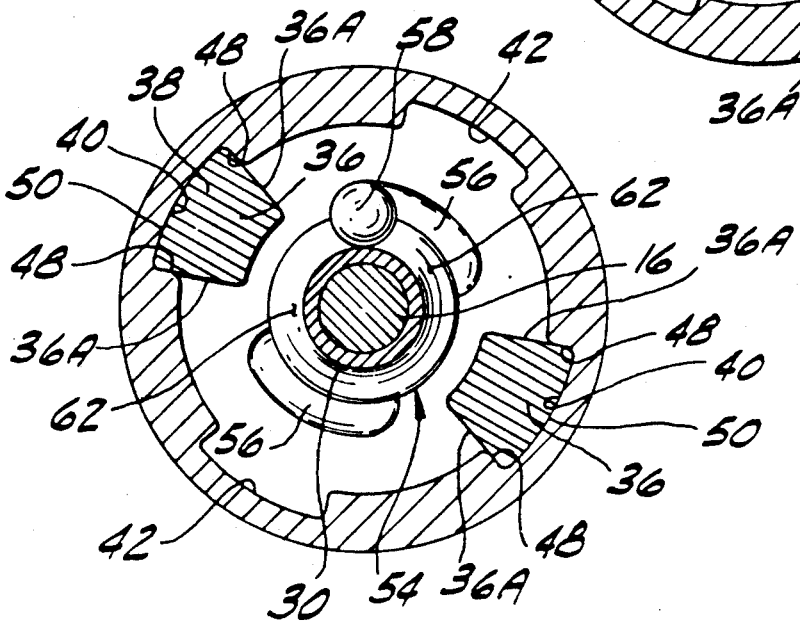
FIG. 6 is a section taken in the plane including line 6—6 of FIG. 3.

The output shaft 16 is supported generally coaxially with the cage 14 for rotation relative to the cage by an annular member 30 at the rearward end of the cage, and a bushing 32 fitted in the forward end of the cage. Two wedge-shaped anvils 34 (broadly "anvil means"), which are formed as one piece with the output shaft 16, project outwardly in radially opposite directions from the output shaft. Each anvil 34 has two generally flat impact surfaces 34A which lie in generally radial planes including the central longitudinal axis of the cage 14. A pair of hammer pins 36 (broadly "hammer means") made of cold-forged steel are received in two axially extending guide channels 40 formed in an internal wall of the cage 14. The other two channels 42 seen in FIGS. 4–6 are formed solely for ease of machining, and are not sized to receive hammer pins 36. The hammer pins 36 each have two generally flat striking surfaces 36A, for engaging the impact surfaces 34A of the anvils 34, and slightly arcuate radially inner and outer surfaces. As located in the guide channels 40, the striking surfaces 36A of the hammer pins 36 generally lie in radial planes including the central longitudinal axis of the cage. The particular impact and striking surfaces 34A, 36A which engage depends upon the direction of rotation of the cage 14 (i.e., for tightening or loosening the fastener element).

Clutch means indicated generally at 46 intermittently moves the hammer pins 36 axially in the guide channels 40 between a retracted position (FIG. 2), in which the striking surfaces 36A of the hammer pins are spaced rearward of and thus clear of the impact surfaces 34A of the anvils to permit rotation of the cage 14 and the hammer pins relative to the output shaft 16 and anvils 34, and an extended position in which a portion of one of the striking surfaces of each of the hammer pins is in registration with one of the impact surfaces for impact thereagainst. When the hammer pins are extended, further rotation of the cage 14 results in an impact of the striking surfaces 36A of the hammer pins against respective impact surfaces 34A of the anvils for transmitting an impact force to the output shaft 16. The essentially instantaneous application of an impact force to the anvils 34 allows the output shaft 16 to develop higher torque for tightening or loosening fastener elements.

The guide channels 40 are shaped for a close sliding fit with the hammer pins 36 to prevent movement of the pins radially out of the channel or lateral within the channel, and thus substantially restrict the hammer pins to movement longitudinally of the cage 14. As shown in FIGS. 5 and 6, the guide channels 40 and the hammer pins 36 both have generally trapezoidal transverse cross sections, and the portion 38 of each hammer pin 36 received in its respective guide channel has a radially inwardly tapering cross section closely corresponding to the tapered cross section of the channel. Each of the guide channels 40 has generally opposing side walls 48 connected by a slightly arcuate transverse wall 50 at the bottom of the channel. The side walls 48 slope inwardly toward each other from their intersection with the transverse wall 50 and thus hold the wider portion 38 of the respective tapered hammer pin 36 captive in the channel, thereby preventing radially inward movement out of the guide channel 40. Moreover, because the guide channel 40 and portion 38 of the hammer pin 36 received in the channel closely correspond in size and shape, the hammer pin cannot move laterally with respect to the guide channel. The importance of limiting the radial and lateral motion of the hammer pins 36 will be explained more fully below with regard to the operation of the rotary impact wrench 10.

Figure 2:
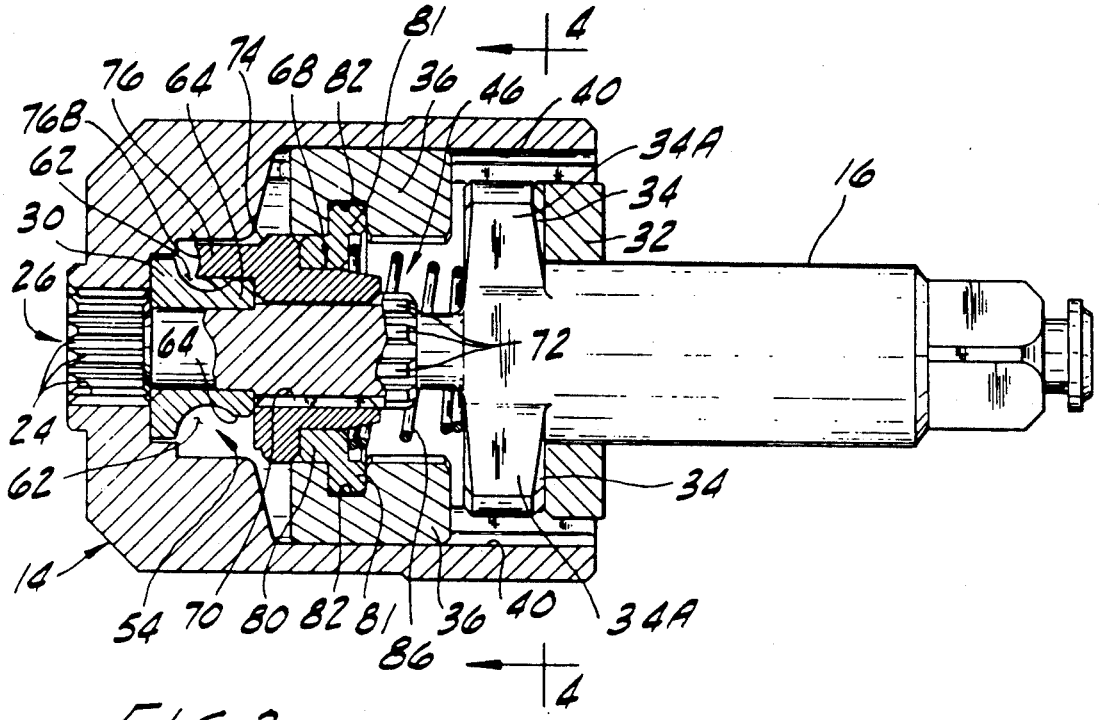
FIG. 2 is a longitudinal section of the cage showing a clutch mechanism and hammer pins in their retracted position.
Figure 3:
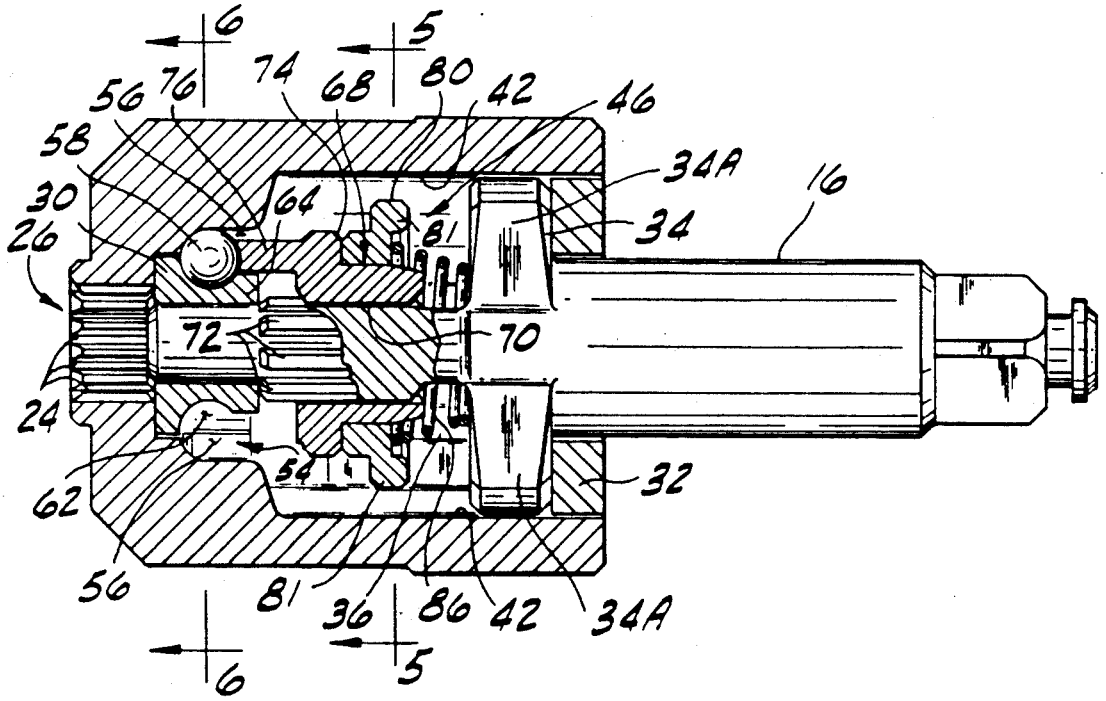
FIG. 3 is a longitudinal section of the cage showing the clutch mechanism with the hammer pins in their extended position.

The rearward end of the cage 14 has a recess 54 which is generally circular and communicates with the opening 26 in the cage. The recess 54 has radially outwardly flaring extensions which define arcuate outer walls of pockets 56. The inner walls of the pockets 56 are defined by the annular member 30 which is positioned coaxially with the central longitudinal axis of the cage 14. As best seen in FIG. 6, the clutch means 46 includes a cam ball 58 which is received in one of the pockets 56. The radially outer surface of the annular member 30, as may be seen in FIG. 2, is concave and defines a raceway 62 in which the cam ball 58 moves around the central longitudinal axis of the cage. A lip 64 at the forward end of the annular member 30 holds the cam ball 58 against axial movement relative to the cage. The pockets 56 are sufficiently large to permit limited motion of the cam ball 58 in the raceway 62 relative the cage 14. However, upon rotation of the cage 14, engagement of the cam ball 58 with the outer wall of the pocket 56, as shown in FIG. 6, drives the cam ball around the raceway 62 in conjoint motion with the cage.

Figure 7:
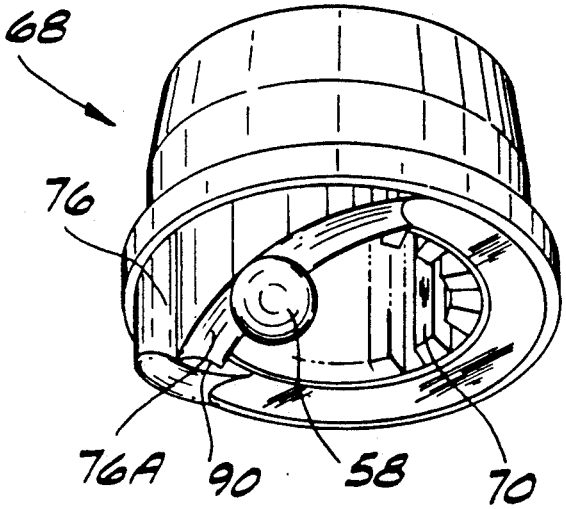
FIG. 7 is a perspective of a cam ball and a cam follower of the clutch mechanism shown in a position of engagement.

A tubular cam follower 68 located forwardly of the annular member 30 fits around the output shaft 16 and is connected by internal splines 70 to splines 72 on the output shaft for conjoint rotation with the output shaft. However, the spline connection leaves the cam follower 68 free to move axially relative the output shaft 16. The cam follower 68 includes a radially outwardly projecting flange 74 which is formed with a finger 76 projecting rearwardly into the recess 54 in the cage 14 where it would be free to rotate in the recess about the central longitudinal axis of the cage 14 but for the presence of the cam ball 58. As shown in FIG. 7, the finger 76 is generally triangular in shape, but bent out of plane so that it follows the circumference of the cam follower flange 74. The sides 76A of the finger serve as ramps so that upon engagement with the cam ball 58 the finger 76 and cam follower 68 are pushed axially forwardly by the cam ball 58. Each of the sides 76A is formed with a shallow trough 76B to facilitate movement of the cam ball 58.

A thrust ring 80 fitted around the forward end of the cam follower 68 is adapted for axial movement with the cam follower. As shown in FIG. 2, the thrust ring 80 has a rim 81 at its periphery which is received in arcuate notches 82 formed in the radially inwardly facing surface of the hammer pins 36. Therefore, it may be seen that the thrust ring 80 links the axial movement of the cam follower 68 and the hammer pins 36 for sliding the hammer pins axially in their respective guide channels 40. A compression spring 86 is coiled around the output shaft 16 and compressed between the rearwardly facing surface of the anvils 34 and the thrust ring 80. The spring 86 biases the thrust ring 80, cam follower 68 and hammer pins 36 rearwardly, away from the anvils 34 of the output shaft 16.

As shown in FIG. 5, the spline connection 70, 72 of the cam follower 68 and the output shaft 16 is keyed so that the cam follower and output shaft are in a predetermined rotational orientation. As may be seen in FIG. 8, the key positions the cam follower finger 76 substantially under one of the anvils 34 of the output shaft 16. The pockets 56 for holding the cam ball 58 are located at positions approximately 90 degrees removed from the guide channels 40. Therefore, engagement of the cam ball 58 with the cam follower finger 76 occurs when the wings 34 are located away from the guide channels 40 to give the hammer pins 36 room to move axially to bring their striking surfaces 36A into registration with the impact surfaces 34A of the anvils.

In operation, the input shaft 18 of the motor (not shown) rotates the cage 14. As shown in FIG. 6, the cam ball 58 is engaged in its raceway 62 by the outer wall of the pocket 56 holding the cam ball, and is carried along with the cage 14 in the raceway 62 about the central longitudinal axis of the cage. The output shaft 16, thrust ring 80 and cam follower 68 are not directly connected to the motor for rotation. However, as the ball is carried around the annular member 30 in the raceway 62, it engages one of the sloped sides 75A of the cam follower finger 76 and wedges against the finger so that the finger is pushed by the ball around the central longitudinal axis to rotate the cam follower 68 conjointly with the cage 14. The output shaft 16 is also rotated because of the spline connection 70, 72 between the cam follower 68 and the output shaft.

When the rotary impact wrench 10 is being used to tighten two fastener elements (not shown), the output shaft 16 is initially loaded with only a small torque resisting its rotation, such as caused by the inertia of the fastener element being turned and the frictional interengagement between the turning and stationary fastener elements. Therefore, although the wedging engagement of the cam ball 58 with the cam follower finger 76 moves the cam follower 68, thrust ring 80 and hammer pins 36 forwardly, the axial component of the force exerted by the cam ball on the finger is insufficient to overcome the force of the spring 86 pushing the thrust ring, hammer pins and cam follower rearwardly to drive the cam ball over the crest 90 (FIG. 8) of the finger. Thus, the cam ball 58 remains engaged with one side 76A of the finger 76, pushing it around the central longitudinal axis such that the cam follower 68 and output shaft 16 rotate with the input shaft 18 of the motor.

Figure 8:
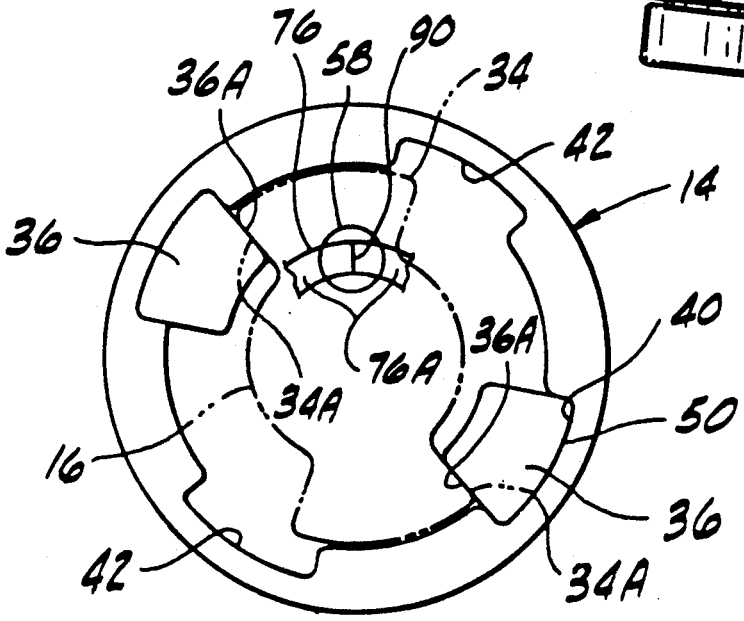
FIG. 8 is a schematic view of the cage illustrating the position of the cam ball of the cam follower when the hammer pins are in their extended position.

As the fastener element being turned by the output shaft 16 engages the surface (not shown) to which it is being tightened, the torque experienced by the output shaft increases markedly. As the resistance to rotation of the output shaft 16 and cam follower 68 increases, the axial component of the force exerted by the cam ball 58 on the finger 76 increases until the cam ball is able to drive the cam follower forward far enough to pass over the crest 90 of the finger and down the opposite side 76A. The engagement of the cam ball 58 with a side 76A of the cam follower finger is illustrated in FIG. 7. FIG. 8 schematically illustrates the position of the cam ball 58, cam follower finger 76, anvils 34 and hammer pins 36 when the cam ball 58 reaches the crest 90 of the finger. As the cam ball 58 moves down the opposite side 76A of the finger, the spring 86 moves the thrust ring 80, hammer pins 36 and cam follower 68 rearwardly to substantially the position shown in FIG. 2.

Thereafter, the cage 14 and cam ball 58 rotate at high speed about the central longitudinal axis until they catch up with the cam follower finger 76. The cam ball 58 hits the cam follower finger 76 with at a high momentum, causing the hammer pins 36 to be thrown forwardly with great force against the resisting force of the spring 86 so that the striking surfaces 36A of the hammer pins are brought into registration with the impact surfaces 34A of the anvils 34 of the output shaft 16. Further revolution causes the flat striking surfaces 36A of the hammer pins 36 to impact the flat impact surfaces 34A of the anvils. Because the impact areas engage one another face-to-face over a relatively large area, momentum from the hammer pins and the cage 14 is efficiently transferred to the anvils 34 and output shaft 16. Because the cam ball 58 drives quickly past the crest 90 of the cam follower finger 76, the hammer pins 36 are pushed quickly rearwardly out of registration with the anvils 34. Therefore, the hammer pins 36 deliver a quick, sharp impact to the anvils 34 to tighten the fastener element an incremental amount, and then release to regain momentum for the next impact.

The momentum of the cage 14, which has a significantly greater weight and hence greater momentum than the hammer pins 36, is also efficiently transferred to the anvils 34 because the hammer pins have a close-fitting relationship with the side walls 48 of the channels 40. Thus, rather than moving laterally or radially as a result of the impact with the anvils 34, the hammer pins 36 are held rigid by their close fit with the side walls 48 of the guide channels so that they transfer substantially the full momentum of the cage 14 to the anvils and output shaft 16. The engagement of the hammer pins 36 with the anvils 34 is brief, and a relatively large amount of torque is delivered to the output shaft 16.

The rotary impact wrench 10 of the present invention is particularly adapted for operation at higher air pressures (e.g., above 90 psi up to about 140 psi). At high pressure, the cage 14 rotates so rapidly that the hammer pins 36 impact the anvils 34 before substantial portions of the striking surfaces 36A of the hammer pins move into registration with the impact surfaces 34A of the anvils. Although the area over which the force of the impact is applied to the hammer pins 36 is reduced from the optimum, it is still applied over a flat area of the hammer pin. Moreover, because the hammer pin is closely held in the channel, much of the impact load on the hammer pins 36 is supported by the cage 14. The channels 40 prevent any lateral or radial movement of the hammer pins 36 relative the channels so that stress developed at the notch 82 engaging the rim 81 of the thrust ring 80 is reduced. The provision of a notch on only one side of the hammer pins reduces stress concentration at the notch. Thus, the hammer pins 36 will not merely skip under the anvils 34, which would cause inefficient transfer of momentum and tend to chip the hammer pins. Therefore, the hammer pins 36 have a long operational life even when high pressure is used.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary impact tool comprising a housing, a generally tubular cage supported for rotation in the housing, a motor mounted in the housing, the motor being connected to the cage for rotating the cage about a central longitudinal axis of the cage, the cage having an internal wall with two axially extending guide channels formed therein at generally diametrically opposite positions, each guide channel having generally opposing side walls and a transverse wall extending between said opposing side walls at the bottom of the channel, said side walls sloping inwardly toward one another from their intersection with the transverse wall, an output shaft mounted generally coaxially with the cage for rotation relative to the cage, the output shaft including anvil means projecting radially outwardly from the output shaft, said anvil means having generally flat impact surfaces, hammer means disposed in said guide channels for movement with the cage, said hammer means having a generally flat striking surface and being adapted for a close sliding fit in the guide channels such that said hammer means is substantially restricted to sliding movement longitudinally of the guide channels, and clutch means for intermittently moving said hammer means axially in said guide channels between a retracted position in which the striking surface of said hammer means is clear of the impact surface of said anvil means for permitting rotation of the cage and said hammer means relative the output shaft, and an extended position in which the striking surface of said hammer means is in registration with the impact surface of said anvil means such that the striking surface of said hammer means is adapted to strike the impact surface of said anvil means upon further rotation of the cage.

2. A rotary impact tool as set forth in claim 1 wherein said guide channels have a transverse cross section tapered radially inwardly toward the longitudinal axis of the cage, and wherein said hammer means has a transverse cross section of complementary tapered shape.

3. A rotary impact tool as set forth in claim 1 wherein said hammer means comprises a hammer pin slidable in each guide channel, a radially outer portion of each hammer pin being received in a respective guide channel, the portion of the hammer pin received in the guide channel having a cross section substantially corresponding in size and shape to the cross section of the channel.

4. A rotary impact tool as set forth in claim 3 wherein each of the hammer pins is generally trapezoidal in cross section.

5. A rotary impact tool as set forth in claim 4 wherein said anvil means comprises two anvils formed as one piece with the output shaft and projecting radially outwardly therefrom in opposite directions, the impact surfaces comprising generally flat sides of the anvils lying in generally radial planes which include said central longitudinal axis of the cage.

6. A rotary impact tool as set forth in claim 1 wherein said clutch means comprises cam means adapted for movement with the cage, cam follower means supported by the output shaft for rotation with the output shaft and for motion lengthwise of the output shaft parallel to the central longitudinal axis of the cage, thrust ring means adapted for engagement with said hammer means for moving said hammer means generally parallel to said central longitudinal axis of the cage, engagement of said cam means with said cam follower means being adapted to move said thrust ring and said hammer means to said extended position.

7. A rotary impact tool as set forth in claim 6 wherein said hammer means comprises a hammer pin slidable in each of said guide channels, the hammer pin having a generally polygonal transverse cross section and a radially inwardly facing surface with a notch therein for receiving a portion of said thrust ring means.

8. A rotary impact tool comprising a housing, a generally tubular cage supported for rotation in the housing, a motor mounted in the housing, the motor being connected to the cage for rotating the cage about a central longitudinal axis of the cage, the cage having an internal wall with axially extending guide channel means formed therein, an output shaft mounted generally coaxially with the cage for rotation relative to the cage, the output shaft including anvil means projecting radially outwardly from the output shaft, said anvil means having impact surfaces, hammer means disposed in said guide channel means for movement with the cage, said hammer means having a striking surface, said guide channel means being shaped for a close sliding fit with said hammer means to substantially restrict said hammer means to movement parallel to said central longitudinal axis of the cage in said guide channel means, and clutch means for intermittently moving said hammer means axially in said guide channel means between a retracted position in which the striking surface of said hammer means is clear of the impact surface of said anvil means for permitting rotation of the cage and said hammer means relative the output shaft, and an extended position in which the striking surface of said hammer means is in registration with the impact surface of said anvil means such that the striking surface of said hammer means strikes the impact surface of said anvil means upon further rotation of the cage, said guide channel means having a transverse cross section tapered radially inwardly toward the longitudinal axis of the cage, said hammer means having a transverse cross section of complementary tapered shape, said guide channel means comprising two guide channels formed at opposite positions in the internal wall of the cage, each guide channel having generally opposing side walls and a transverse wall extending between said opposing side walls at the bottom of the channel, said side walls sloping inwardly toward one another from their intersection with the transverse wall.

9. A rotary impact tool as set forth in claim 8 wherein said hammer means comprises a hammer pin slidable in each guide channel, a radially outer portion of each hammer pin being received in a respective guide channel, the portion of the hammer pin received in the guide channel having a cross section substantially corresponding in size and shape to the cross section of the channel.

10. A rotary impact tool as set forth in claim 9 wherein each of the hammer pins is generally trapezoidal in cross section.

11. A rotary impact tool as set forth in claim 10 wherein said anvil means comprises two anvils formed as one piece with the output shaft and projecting radially outwardly therefrom in opposite directions, the impact surfaces comprising generally flat sides of the anvils lying in generally radial planes which include said central longitudinal axis of the cage.

12. A rotary impact tool as set forth in claim 8 wherein said clutch means comprises cam means adapted for movement with the cage, cam follower means supported by the output shaft for rotation with the output shaft and for motion lengthwise of the output shaft parallel to the central longitudinal axis of the cage, thrust ring means adapted for engagement with said hammer means for moving said hammer means generally parallel to said central longitudinal axis of the cage, engagement of said cam means with said cam follower means being adapted to move said thrust ring and said hammer means to said extended position.

13. A rotary impact tool as set forth in claim 12 wherein said hammer means comprises a hammer pin slidable in each of said guide channel means, the hammer pin having a generally polygonal transverse cross section and a radially inwardly facing surface with a notch therein for receiving a portion of said thrust ring means.

14. A rotary impact tool comprising a housing, a motor mounted in the housing, an output shaft mounted for rotation about it longitudinal axis, the output shaft including anvil means projecting radially outwardly from the output shaft, said anvil means having an impact surface, hammer means having a striking surface adapted for intermittently engaging the impact surface of said anvil means, means mounting said hammer means in the housing, said mounting means being supported for rotation in the housing about an axis generally parallel to said longitudinal axis of the output shaft and connected to the motor, said mounting means including guide channel means extending generally parallel to said longitudinal axis of the output shaft, said guide channel means comprising at least one guide channel formed in said mounting means, the said at least one guide channel having generally opposing side walls and a transverse wall extending between said opposing side walls at the bottom of the said at least one guide channel, said side walls converging toward one another in a direction away from the transverse wall to substantially restrict said hammer means to movement parallel to said longitudinal axis of the output shaft in said guide channel means, and clutch means for intermittently moving said hammer means axially in said guide channel means between a retracted position in which the striking surface of said hammer means is clear of the impact surface of said anvil means for permitting rotation of said mounting means and said hammer means relative the output shaft, and an extended position in which the striking surface of said hammer means is in registration with the impact surface of said anvil means such that the striking surface of said hammer means strikes the impact surface of said anvil means upon further rotation of said mounting means.

* * * * *